United States Patent [19]

Villeval

[11] Patent Number: 4,491,174

[45] Date of Patent: Jan. 1, 1985

[54] LIQUID FLOW HEAT EXCHANGER, E.G. FOR A MOTOR VEHICLE

[75] Inventor: Denis Villeval, Maurepas, France

[73] Assignee: Valeo, Paris, France

[21] Appl. No.: 425,235

[22] Filed: Sep. 28, 1982

[30] Foreign Application Priority Data

Oct. 13, 1981 [FR] France ..... 81 19272

[51] Int. Cl.[3] ..... F28D 15/00; F01P 11/02

[52] U.S. Cl. ..... 165/104.32; 123/41.54; 165/11 R

[58] Field of Search ..... 165/104.32; 123/41.54

[56] References Cited

U.S. PATENT DOCUMENTS 1,644,270 10/1927 Paone .

3,254,707 6/1966 Ferguson ..... 165/104.32

4,366,858 1/1983 Moranne ..... 165/104.32

*Primary Examiner*—Albert W. Davis, Jr.

*Attorney, Agent, or Firm*—Dennison, Meserole, Pollack & Scheiner

[57] ABSTRACT

In a liquid flow heat exchanger, such as the radiator in the cooling circuit for an internal combustion engine in a motor vehicle, the heat exchanger proper comprises a bundle of tubes (10) having at least a first water box (11) mounted at one end thereof and serving as a manifold chamber giving access to the ends of the tubes in the bundle. A passage (20) is provided for degassing the liquid, and the passage passes through the mid portion of the bundle of tubes (10) to connect the first water box (11) to an expansion chamber (16). Preferably the passage includes one of the tubes (21) in the bundle.

8 Claims, 5 Drawing Figures

III
18
10
11
12
14
15
13
22
21
20
17
23
13
16
24
19
II

I
25
12
23
21
25
24
I

IV
39
30
31
34
41
33
32
36
45
43
38
44
46
37
42
35
40
IV

III
47
32
38
44
46
47
III 50
51
63
60
53
54
61
56
58
63
52
57
62
59
55

LIQUID FLOW HEAT EXCHANGER, E.G. FOR A MOTOR VEHICLE

The present invention relates to a liquid flow heat exchanger, and in particular to the radiator in the cooling circuit of an internal combustion engine. Such a heat exchanger generally comprises a bundle of tubes through which the liquid flows, and a water box mounted at each end of the bundle of tubes, said water boxes including liquid inlet and outlet tubes to the heat exchanger as a whole. One of said water boxes constitutes both a manifold chamber into which the ends of the tubes in the bundle open out, and an expansion chamber which communicates with the bottom of the manifold chamber and/or the outlet tube, and which is provided with a top opening which is closed by a stopper fitted with calibrated pressure release valves for releasing both overpressure and underpressure.

BACKGROUND OF THE INVENTION

It is already known practice to provide a degassing passage leading from the manifold chamber to the degassing chamber, whereby bubbles of air or gas which are conveyed by the cooling liquid and which tend to collect in the top of the manifold chamber may be evacuated via said passage to the expansion chamber.

However, if the liquid inlet tube to the heat exchanger opens out into the top of the same manifold chamber, turbulence is created in this region which tends to prevent the bubbles from coalescing there, which renders the degassing passage almost useless.

Preferred embodiments of the present invention provide a simple, cheap and effective solution to this problem.

SUMMARY OF THE INVENTION

The present invention provides a liquid flow heat exchanger, in particular for a motor vehicle, the heat exchanger comprising a bundle of tubes having at least a first water box mounted at one end thereof and serving as a manifold chamber giving access to the ends of the tubes in the bundle, wherein a passage for degassing the liquid passes through the mid portion of the bundle of tubes to connect said first water box to an expansion chamber.

Thus, in accordance with the invention, the degassing passage passes through the bundle of tubes, and this is particularly advantageous in the conditions mentioned above where the inlet tube to the heat exchanger opens out into a water box moulding which combines both a manifold chamber and an expansion chamber. It has been observed that under such conditions the bubbles of air or gas conveyed by the liquid tend to collect in the other water box of the heat exchanger at the other end of the bundle of tubes from the expansion chamber.

Naturally the invention is also applicable to cases where the expansion chamber is independent of both water boxes of the heat exchanger.

Preferably the degassing passage passes through the bundle of tubes by using one of the tubes in the bundle which is reserved for this purpose.

BRIEF DESCRIPTION OF THE DRAWINGS

An embodiment of the invention is described by way of example with reference to the accompanying drawing, in which.

MORE DETAILED DESCRIPTION

Figure 1:
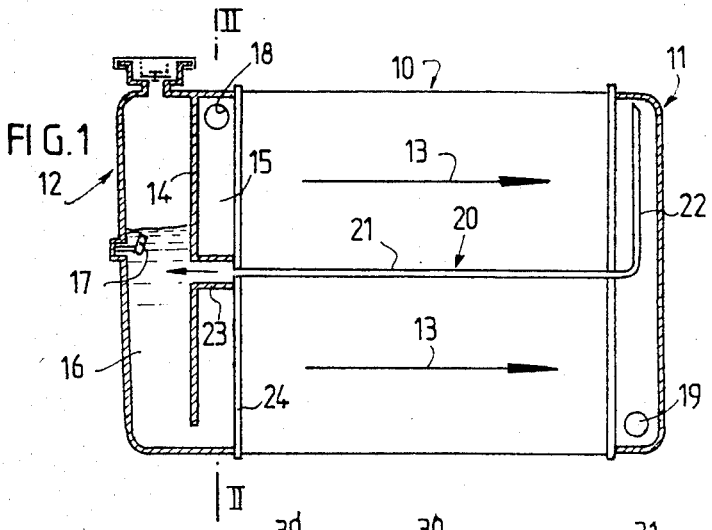
FIG. 1 is a diagrammatic longitudinal section through a first heat exchanger in accordance with the invention and on line I—I shown in FIG. 2.
Figure 2:
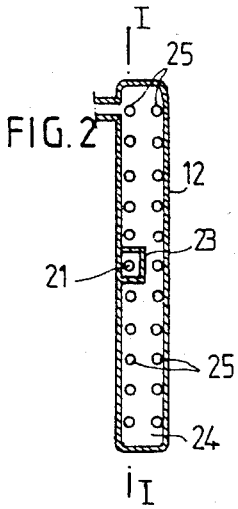
FIG. 2 is a cross section on line II—II of FIG. 1.

Reference is made initially to FIGS. 1 and 2 which show a first embodiment of the invention.

The exchanger in FIGS. 1 and 2 comprises a bundle 10 of tubes which are disposed generally horizontally. At the ends of the bundle there are first and second water boxes 11 and 12 into which the ends of the tubes in the bundle 10 open out. The heat exchanger is an I-type flow exchanger, ie. the liquid flows through all the tubes in the bundle 10 in the direction indicated by arrows 13.

The second water box 12 is divided by an internal wall 14 into a manifold chamber 15 into which the corresponding ends of the tubes in the bundle 10 open out, and an expansion chamber 16 which may include a level detector 17 situated, for example, slightly above the horizontal mid plane passing through the water box 12. A liquid inlet tube 18 to the heat exchanger opens out into the top of the manifold chamber 15, and a liquid outlet tube from the heat exchanger opens out into the bottom of the first water box 11. In accordance with the invention a degassing passage referenced overall as 20 connects the top of the first water box 11 to the expansion chamber 16. The passage 20 is advantageously constituted by one of the tubes in the bundle 10, which tube is extended at its first water box end by a vertical tube 22, and at its second water box end by a duct 23 leading to the expansion chamber 16.

As can be seen in FIG. 2, the duct 23 passes through the wall 14 separating the manifold chamber 15 from the expansion chamber 16, and is obtained as part of a one-piece moulding which constitutes the second water box 12. The duct 23 extends from said internal wall 14 to a perforated plate 24 having holes for mounting the end of each of the tubes 25 in the bundle 10, together with the degassing passage tube 21. The duct 23 surrounds the end of the tube 21 and separates it in a watertight manner from the ends of the other tubes 25 in the bundle.

Although any of the tubes in the bundle 10 could be selected to serve in the degassing passage 20, a tube located in the mid plane of the bundle is preferred, so as to remain below the level of liquid contained in the expansion chamber under normal conditions of heat exchanger operation. The duct 23 is axially aligned with the tube 21 and thus opens out into the expansion chamber 16 below the level of liquid, thereby avoiding any risk of air being sucked back along the degassing passage 20, eg. when the internal combustion engine is stopped.

The heat exchanger operates as follows: p The cooling liquid of an internal combustion engine enters the manifold chamber 15 of the second water box 12 via the inlet tube 18 and flows through all the tubes of the bundle 10 other than the degassing tube 21 in the direction of the arrows 13 to reach the first water box 11 and leave the heat exchanger via the outlet tube 19. Bubbles of air or gas conveyed by the liquid then tend to collect in the top of the first water box 11, whence they are taken by the degassing passage 20 and evacuated into the expansion chamber 16 by virtue of the lower pressure therein. The speed of liquid flow is uniform and relatively slow in the top of the first water box 11, which provides good conditions for degassing.

Figure 3:
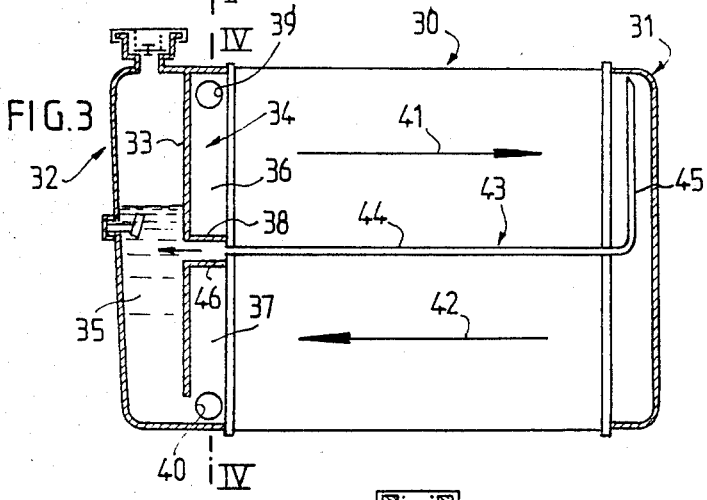
FIG. 3 is a longitudinal section through a second heat exchanger in accordance with the invention and on line III—III in FIG. 4.
Figure 4:
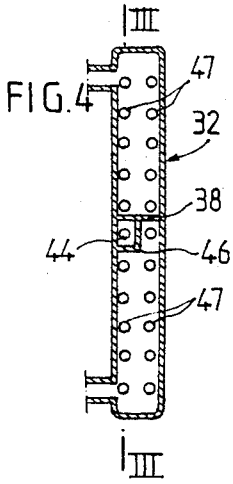
FIG. 4 is a cross section on line IV—IV in FIG. 3.

Reference is now made to FIGS. 3 and 4 which show a second embodiment of the invention.

In the second embodiment first and second water boxes 31 and 32 are again mounted at the ends of a bundle 30 of tubes. The first water box 31, however, has neither a liquid inlet tube, nor a liquid outlet tube. The second water box 32 is again divided by an internal wall 33 into a manifold chamber 34 into which the ends of the tubes in the bundle 30 open out, and an expansion chamber 35. The manifold chamber 34 is further divided into an upper compartment 36 and a lower compartment 37 by means of an internal transverse partition 38. An inlet tube 39 for admitting liquid into the heat exchanger opens out into the top of the upper compartment 36, while an outlet tube 40 opens out into the bottom of the lower compartment 37.

As in the preceding embodiment, the internal wall 33 stops short distance from the bottom horizontal wall of the second water box 32, thereby leaving a connection between the expansion chamber 16 and the bottom of the manifold chamber 34 and its outlet tube 40.

This second heat exchanger has U-type liquid flow, ie. the cooling liquid enters the upper compartment 36 of the manifold chamber 34 via the inlet tube 39, flows through the tubes in the upper half of the bundle as shown by an arrow 41 to reach the first water box 31, and then flows back to the second water box 32 through the tubes of the lower half of the bundle 30 in the direction of an arrow 42. The liquid thus flows into the lower compartment 37 of the manifold chamber 34 after following a U-shaped path through the bundle of tubes 30, and finally leaves the heat exchanger 30 via the outlet tube 40.

A degassing passage 43 in accordance with the invention is formed, as in the preceding embodiment, by one of the tubes 44 in the bundle 30; said tube having its first water box end extended by a vertical tube 45 pointing upwards, and having its second water box end connected through to the expansion chamber 35 via a duct 46 which opens out therein below its normal level of liquid. Advantageously, the duct 46 is made in a single one-piece moulding together with the walls of the second water box 32 and its transverse partition 38, and it opens out into the expansion chamber 35 via a corresponding opening through the internal wall 33. As can be seen in FIG. 4, the duct 46 separates the end of the tube 44 from the ends of the other tubes in the bundle in a watertight manner.

The second embodiment of the heat exchanger operates in the same way as that already described for the first embodiment.

Figure 5:
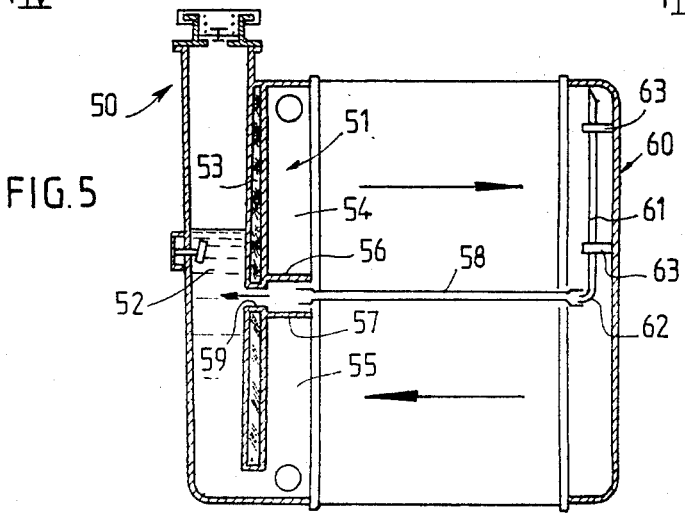
FIG. 5 is a longitudinal section through a third heat exchanger in accordance with the invention.

Reference is now made to FIG. 5 which shows an advantageous variation of the heat exchanger shown in FIG. 3.

In this embodiment, the second water box 50 constituting the manifold chamber 51 and the expansion chamber 52 is made as a single one-piece moulding. The manifold chamber and the expansion chamber are separate enclosures held together by a flat strip 53 forming part of the moulding. The manifold chamber is divided into two compartments 54 and 55 by an internal transverse partition 56 which also serves to support the duct 57 which connects the end of the degassing tube 58 through the bundle of tubes to the expansion chamber 52 and separates said end in a watertight manner from the ends of the other tubes in the bundle. The connection through to the expansion chamber is by means of a horizontal cylindrical portion 59 which opens out into the expansion chamber below the normal level of liquid therein.

The other water box 60 contains an upwardly directed vertical tube 61 with its top end near to the top of the water box 60 and with a bent lower end 62 which engages in a substantially watertight manner into the end of the degassing tube 58 through the bundle. The tube 60 may merely project into the water box 60, or else it may be held in place, as shown, by clipping into elastically deformable lugs 63 projecting from the wall of the water box 60.

I claim:

1. A liquid flow heat exchanger comprising:

(a) a bundle of tubes;

(b) a first water box mounted at one end of said bundle of tubes;

(c) a second water box which includes an expansion chamber and is mounted at the end of said bundle of tubes opposite said first water box; and (d) a liquid degassing passage extending from said first water box, through the mid-portion of said bundle of tubes through said second water box to connect with said expansion chamber; wherein a portion of said passage which passes through said second water box is comprised by a duct which is molded in one piece with said second water box and which connects said expansion chamber with the passage portion passing through said bundle of tubes.

2. A heat exchanger according to claim 1, comprising an inlet tube for admitting liquid into the heat exchanger, said inlet tube opening into said second water box.

3. A heat exchanger according to claim 1, wherein said degassing passage includes one of the tubes of said bundle, said tube being situated in the mid portion of the bundle.

4. A heat exchanger according to claim 1, including a transverse partition dividing the second water box into two compartments, and wherein said duct is in part constituted by said transverse partition.

5. A heat exchanger according to claim 1, wherein said duct opens out into the expansion chamber below the level of liquid contained in said expansion chamber during normal operating conditions of the heat exchanger.

6. A heat exchanger according to claim 3, wherein the degassing passage includes a bent pipe placed in said first water box and having one end connected to the first water box end of said one of the tubes.

7. A heat exchanger according to claim 6, wherein said first water box is generally vertically oriented, and wherein the other end of said bent pipe opens out near the top of said first water box.

8. A heat exchanger according to claim 6, wherein said bent pipe is fixed to the inside of the wall of said first water box.

* * * * *